United States Patent [19]

Howard

[11] 4,338,584

[45] Jul. 6, 1982

[54] TELEVISION DEFLECTION YOKE MOUNT

[75] Inventor: John V. Howard, East Petersburg, Pa.

[73] Assignee: RCA Corporation, New York, N.Y.

[21] Appl. No.: 209,534

[22] Filed: Nov. 24, 1980

[51] Int. Cl.[3] ..... H01F 7/00

[52] U.S. Cl. ..... 335/210; 335/212; 358/248

[58] Field of Search ..... 335/210, 212; 358/248, 358/249

[56] References Cited

U.S. PATENT DOCUMENTS

| | | | |
|---|---|---|---|
| 3,302,050 | 1/1967 | Obert et al. | 335/210 |
| 3,986,156 | 10/1976 | Smith | 335/210 |
| 4,117,516 | 9/1978 | Yasuhara | 358/248 |
| 4,186,414 | 1/1980 | Barinek | 358/248 |
| 4,195,315 | 3/1980 | Pytlarz et al. | 358/248 |

*Primary Examiner*—Harold Broome

*Attorney, Agent, or Firm*—E. M. Whitacre; P. J. Rasmussen; S. J. Stevens

[57] ABSTRACT

A mounting apparatus for use with a television deflection yoke adapted for transverse adjustment on a kinescope comprises an insulator adapted to be fixedly mounted on the neck of the kinescope at the rear of the insulator. The insulator receives horizontal and vertical deflection coils, and a magnetically permeable core, to form a deflection yoke. A plurality of yoke position orientation and fixing means are mounted to the front of the insulator. The position orientation and fixing means each comprise a guide means incorporating a first engagement means. A member, incorporating second engagement means, is slidably disposed within the guide means. The first and second engagement means cooperate to allow the deflection yoke to be securely held in its adjusted position when the sliding member of each orientation and fixing means is in abutment with the kinescope.

5 Claims, 16 Drawing Figures

TELEVISION DEFLECTION YOKE MOUNT

This invention relates to mounting apparatus for holding a deflection yoke in operating relationship to a television picture tube.

Color television receivers are increasingly being manufactured with picture tubes which produce three horizontally aligned electron beams. Deflection yokes for such tubes may then be made which can substantially converge the electron beams at all points on the picture tube display screen without the need for dynamic convergence circuitry. In order to provide beam convergence within acceptable tolerances, the horizontal and vertical coils of these self-converging deflection yokes must be precisely located and aligned with respect to each other and to the electron beams. Imprecise positioning of the yoke coils can result in problems, such as asymmetrical deflection fields, which can adversely affect beam convergence.

In order to realize proper yoke positioning in some applications, the yoke is adjusted and aligned on the tube during final assembly, either manually or automatically by a yoke adjustment machine. When the desired position of the yoke is realized, it is important to secure the yoke with respect to the kinescope so that movement of the yoke does not occur. One technique to accomplish this is through the use of wedges, usually made of rubber or plastic, usually inserted manually by an operator at the front of the yoke between the yoke and the tube. These wedges are satisfactory to prevent movement of the yoke with respect to the tube. However, they may be difficult to insert in some receivers, notably those having small screen sizes, where the ability to reach the front of the yoke is severely limited due to cramped space conditions.

The use of screw type adjustment means, such as disclosed in U.S. Pat. No. 4,195,315, alleviates the cramped quarters limitation somewhat, but the function of turning a screw complicates the yoke alignment process somewhat. Particularly, with the use of automatic yoke adjustment apparatus the problem with properly aligning a screw driving tool with the adjustment screw can become quite significant, thereby increasing the cost and complexity of the yoke adjustment process.

It is also desirable to manufacture the yoke adjustment or position fixing means integral with the yoke. Use of additional adjustment platforms mounted to the kinescope or housings mounted to the yoke may increase the cost and complexity of the final assembly. Also, the use of such platforms or housings may increase the chances that yoke movement subsequent to final adjustment may occur due to the increase in the number of parts interacting with the yoke.

In accordance with the present invention, a deflection yoke mounting apparatus provides orientation and fixing of the position of a deflection yoke on a kinescope. The yoke is adapted for transverse adjustment on the kinescope.

The yoke mounting apparatus comprises an insulator, disposed about the neck of the kinescope, which is adapted to be fixedly mounted to the kinescope neck at the rear of the insulator. The insulator is dimensioned to receive horizontal and vertical deflection coils, and a core to form a deflection yoke.

A plurality of yoke position orientation and fixing means are disposed at the front of the insulator and comprise guide means which incorporate a flexible first engagement means. A member incorporating second engagement means is slidably mounted in the guide means. The first and second engagement means cooperate to allow sliding movement of the member toward the kinescope but substantially prevent sliding movement of the member away from the kinescope. The member is placed in abutment with the kinescope to orient and fix the position of the yoke with respect to the kinescope.

In the accompanying drawing.

Figure 8A:
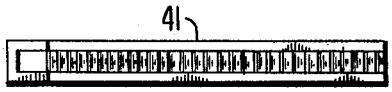
Figure 8C:
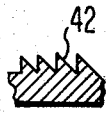
Figure 8B:
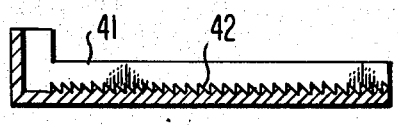

FIGS. 8*a* and 8*b* are top and side views, respectively, of a yoke positioning member in accordance with the present invention;

FIG. 8*c* is an enlarged detail of a portion of the positioning member of FIG. 8*b;*

Figure 9A:
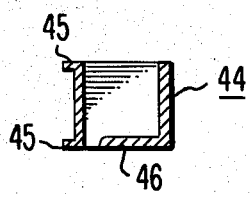
Figure 9B:
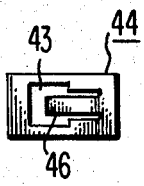

FIG. 9*a* is a side cross-sectional view of a yoke positioning member guide;

FIG. 9*b* is a front view of the positioning member guide shown in FIG. 9*a;*

Figure 10:
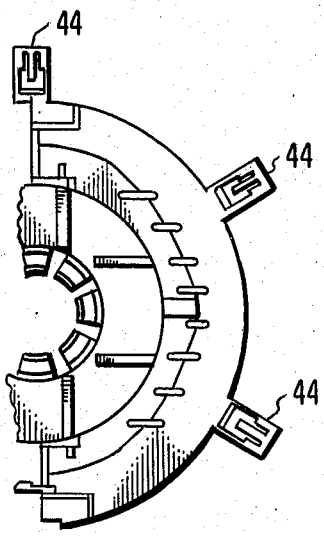
Figure 11A:
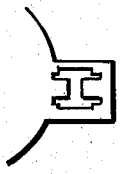

FIG. 10 is a rear elevational view of an alternate embodiment of a portion of a deflection yoke mount, in accordance with the present invention;

FIG. 11*a* is a front view of an alternate embodiment of the positioning member guide of FIGS. 9*a* and 9*b;*

Figure 11B:
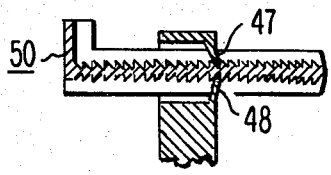
Figure 11C:
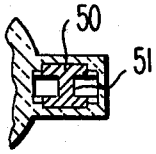

FIG. 11*b* is a side cross-sectional view of an alternate embodiment of a yoke positioning member, illustrating its operation in connection with the positioning member guide shown in FIG. 11*a;* and FIG. 11*c* is a front cross-sectional view of the arrangement shown in FIG. 11*b*.

Figure 1:
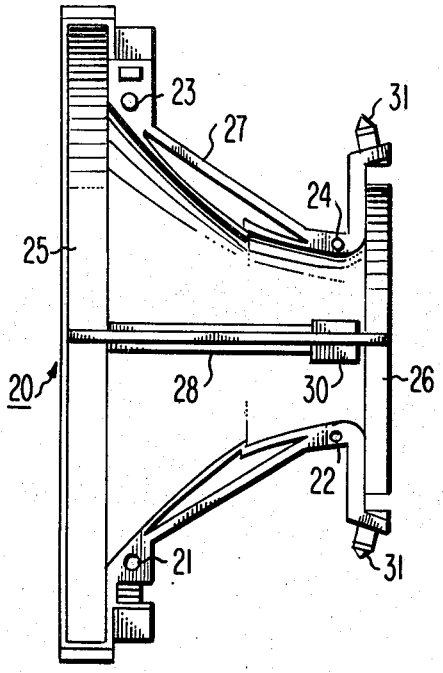
FIG. 1 is a side elevational view of a portion of a deflection yoke mount in accordance with the present invention.

Referring to FIG. 1, there is shown a deflection yoke insulator portion 20 of a deflection yoke mount. Insulator portion 20 represents one half of a complete insulator, with each half being identical with corresponding indexing and locating members. Indexing holes 21 and 22 and indexing pins 23 and 24 are shown in FIG. 1. Insulator 20 includes channels within front and rear portions 25 and 26 of the insulator for receiving the return windings of a horizontal deflection saddle coil. Stiffening ribs 27 are located along the outside of the insulator flare. A ridge 28 runs the length of insulator 20 to separate the horizontal deflection coils. A magnetically permeable core (not shown) toroidally-wound with the vertical deflection coils fits around the outside of insulator 20. Insulator 20 also incorporates an opening 30 which permits the insertion of a spacing member (not shown) in order to increase the separation between the horizontal coils. Tabs 31 are designed to receive a terminal board (not shown) in a snap-on fashion for easy electrical connection of the deflection coils to the receiver deflection circuitry.

Figure 2:
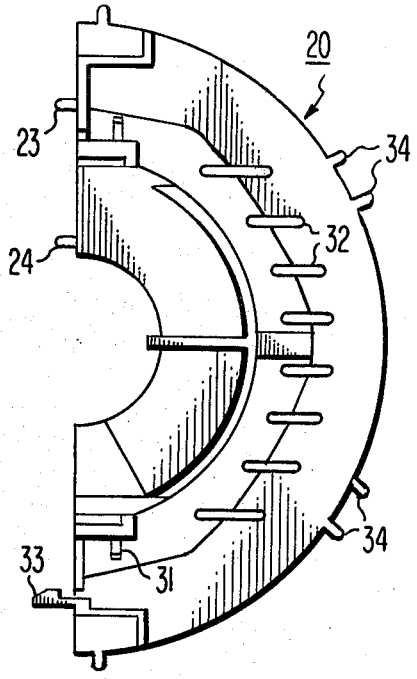
FIG. 2 is a rear elevational view of the deflection yoke mount portion shown in FIG. 1.

FIG. 2 illustrates a rear view of the insulator 20. Indexing pins 23 and 24 can be seen. Insulator stiffening ribs 32 are located along the outside of insulator 20 to reduce distortion or bending of the insulator. An insulator locking tab 33 snaps into a corresponding slot in a second insulator half.

Around the perimeter of the front 25 of insulator 20 are located ridges 34. These ridges occur in pairs when the insulator is completed and form slots between the ridges for receiving a yoke positioning apparatus to form a deflection yoke mount. The construction and operation of the yoke positioning apparatus will be explained later.

Figure 3:
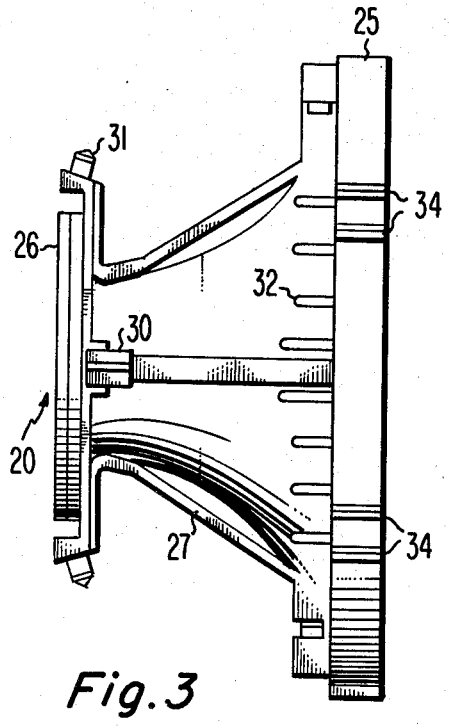
FIG. 3 is a side elevational view of the deflection yoke mount portion of FIG. 1.

FIG. 3 shows a view of the outer surface of insulator 20. It can be seen that ridges 34 extend along the front portion 25 of insulator 20.

Figure 4:
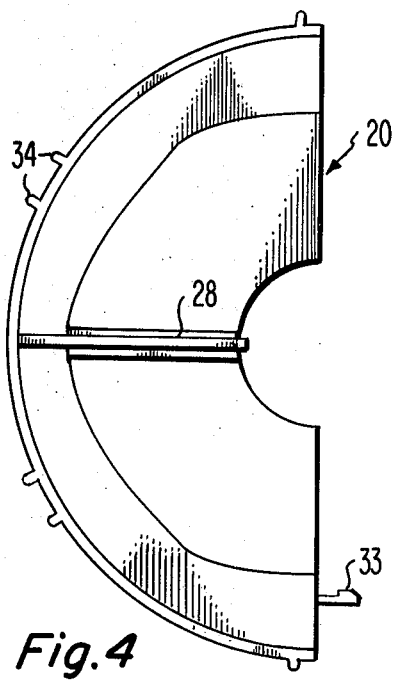
FIG. 4 is a front elevational view of the deflection yoke mount portion of FIG. 1.

FIG. 4 shows a front view of insulator 20. Coil separation ridge 28, ridges 34 and locking tab 33 can easily be seen.

Figure 5:
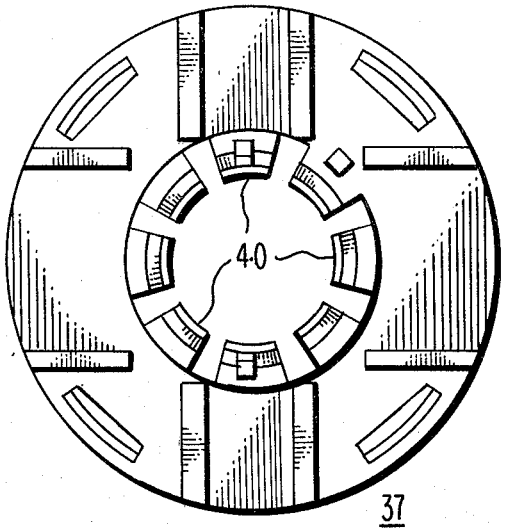
FIG. 5 is a top view of another portion of a deflection yoke mount, in accordance with the present invention.
Figure 6:
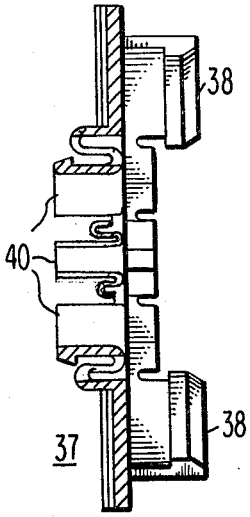
FIG. 6 is a side cross-sectional view of the deflection yoke mount portion shown in FIG. 5.

An insulator cap 37 is illustrated in FIGS. 5 and 6. Cap 37 fits over the small end 26 of insulator 20. Snap tabs 38 on cap 37 fit over the outer edges of end 36 of insulator 20. Cap 37 incorporates fingers 40 which encircle the kinescope neck and receive a clamp (not shown) for securing the completed yoke to the kinescope. FIG. 6 shows a side cross-sectional view of the cap 37.

Figure 7:
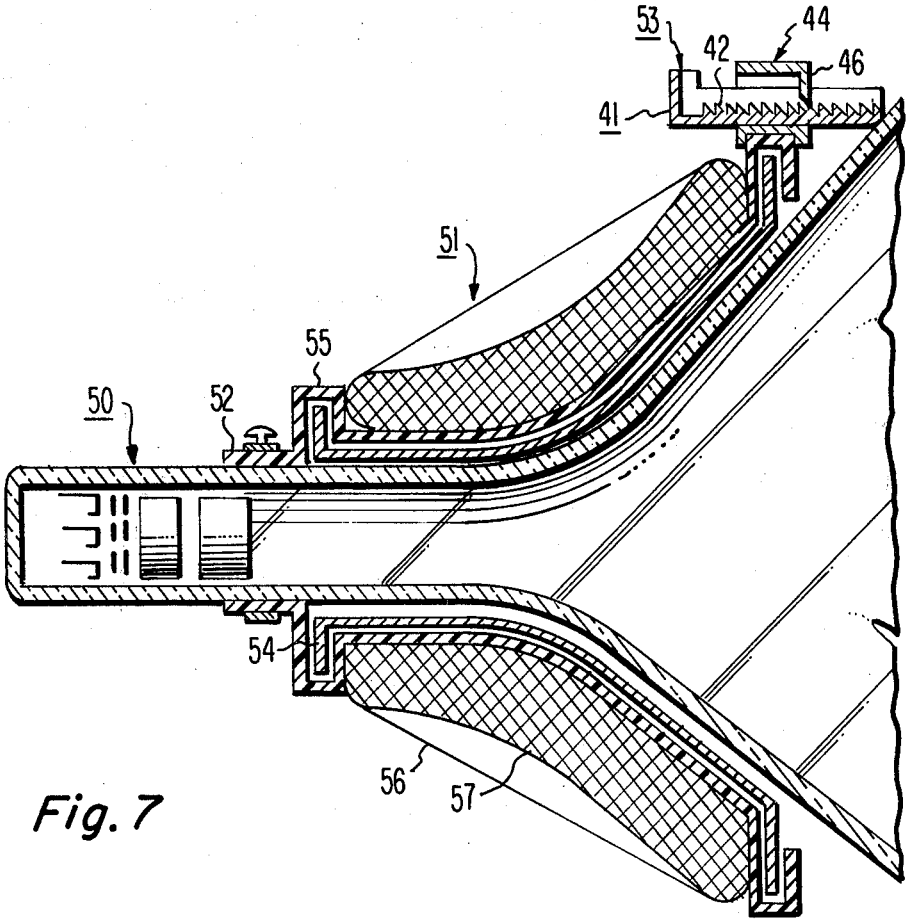
FIG. 7 is a top cross-sectional view of a television display system, illustrating the operation of a yoke positioning apparatus in accordance with the present invention.

FIG. 7 illustrates a color television display system comprising a kinescope 50 and a deflection yoke 51. The yoke 51 is shown mounted to the kinescope 50 at the rear of the yoke via clamp 52. The yoke 52 comprises saddle-type horizontal deflection coils 54, an insulator 55, and vertical deflection coils 56 toroidally-wound on a magnetically permeable core 57. A yoke orientation and fixing means 53 is mounted to the yoke insulator 55 and contacts the kinescope 50 in such a manner to secure the position of the yoke 51 with respect to kinescope 50. In a peferred embodiment, three orientation and fixing means 53 are located at 120° intervals around the perimeter of the front of insulator 55. The construction and operation of the orientation and fixing means will now be described with reference to FIGS. 7–11*c*.

FIGS. 8*a–c* illustrate a yoke positioning member 41 which comprises an elongated U-shaped channel with a shorter U-shaped member at right angles to the elongated member. Only the elongated member is required to be U-shaped, but for ease in manufacture a single U-shaped piece may be bent to form the structure of member 41. Along the inside surface of the base of the U-shaped elongated portion of member 41 is a plurality of ratchet teeth 42, seen clearly in the enlarged detail of FIG. 8*c*. Member 41 fits within the U-shaped channel 43 formed in guide member 44 (seen in FIG. 9*b*). Guide member 44 is dimensioned to fit between ridges 34 on insulator 20, for example. Feet-like projections 45 on guide 44 fit over the front and rear edge of end 25 of insulator 20 to secure it in place.

The U-shaped channel 43 in guide 44 is formed by way of flexible ratcheting member 46 which extends into the internal cavity of guide 44. Ratcheting member 46 interacts with the inclined teeth 42 of member 41 to resist the removal of member 41 from guide 44 similar to the operation of all ratchet systems.

In one application, the yoke is fixed to the kinescope neck via clamp 52 and temporarily held at the front by an automatic yoke adjustment machine. The yoke is then adjusted transversely with respect to the kinescope by the yoke adjustment machine. It is to be understood that the yoke is positioned initially on the kinescope with sufficient space at the front of the yoke to allow transverse adjustment by the yoke adjustment machine. When the yoke is adjusted to optimize its position on the kinescope, members 41 located around the perimeter of the front end of the yoke insulator are pushed manually or automatically into their corresponding guides 44 until they contact the kinescope. The operation of pushing members 41 is much simpler and easily accomplished than turning a screw or inserting a wedge. With three positioning apparatus evenly spaced about the perimeter of the yoke (at approximately 120° intervals), the yoke will be held firmly in position when the three members 41 contact the glass of the kinescope. To further secure the yoke, a glue or plastic resin may be inserted into the cavity of guides 44 and/or at the points of contact of members 41 with the kinescope. FIG. 10 illustrates an embodiment of deflection yoke mount in which guides 44 are molded as a portion of the insulator, rather than being attached separately. It is to be noted that pairs of ridges 34 and molded guides 44 (in FIG. 10) occur every 60° rather than every 120° as needed. This permits the yoke to be assembled without regard for a particular insulator orientation. It is possible therefore, to place positioning members 41 at particular angular position with respect to a fixed reference in all cases, thereby greatly simplifying yoke assembly.

FIGS. 11*a–c* illustrate an alternative embodiment of the deflection yoke mount in which the positioning member presents an increased resistance to removal from the guide once it has been inserted, with respect to the positioning apparatus previously described. This allows the positioning of the yoke on the kinescope without additional adhesive. FIG. 11*a* shows a guide in which two flexible ratcheting members 47 and 48 act to form an H-shaped channel. The cross-section of the positioning member 50 is also H-shaped with ratchet teeth 51 located along the two surfaces which interact with ratcheting members 47 and 48. The effect of inserting member 50 into the guide is to distort the ratcheting members 47 and 48 as shown in FIG. 11*b* such that member 50 will be held in the desired position and will thereby hold the yoke permanently in position when the yoke adjustment apparatus is removed.

The previously described embodiment of a deflection yoke mount permits a simple, economical means for accurately holding a deflection yoke in position after it has been aligned with respect to the kinescope. The ratcheting action of the positioning means allows a quick, simple fixing of the yoke position which is easily accomplished either manually or with an automatic apparatus. The positioning means described provide a positive, one-way action which prevents the yoke from becoming dislodged from its desired position.

What is claimed is:

1. A deflection yoke mounting apparatus providing orientation and fixing of the position of a deflection yoke adapted for transverse adjustment on a kinescope, said mounting apparatus comprising:

an insulator disposed about the neck of said kinescope and adapted to be fixedly mounted to said neck at the rear of said insulator, said insulator dimensioned to receive horizontal and vertical deflection coils and an operatively associated magnetically permeable core to form a deflection yoke;

a plurality of yoke position orientation and fixing means disposed at the front of said insulator, comprising:

guide means incorporating flexible first engagement means; and a member, slidably mounted in said guide means, and incorporating second engagement means, said second engagement means cooperating with said first engagement means to allow sliding movement of said member in a direction toward said kinescope and to substantially prevent sliding movement of said member in a direction away from said kinescope, said member being placed in abutment with said kinescope to orient and fix the position of said yoke with respect to said kinescope.

2. The arrangement defined in claim 1, wherein said second engagement means comprise teeth which cooperate with said first engagement means in a ratcheting manner.

3. The arrangement defined in claim 2, wherein said teeth are inclined to permit substantially one-way movement of said member with respect to said guide means.

4. The arrangement defined in claim 1, wherein said yoke position fixing means are equally spaced about the front of said insulator at 120° angular intervals.

5. The arrangement defined in claim 1, wherein said insulator is disposed between said horizontal and vertical deflection coils.

* * * * *